US006663075B2

(12) United States Patent
Zuller

(10) Patent No.: US 6,663,075 B2
(45) Date of Patent: Dec. 16, 2003

(54) HEIGHT ADJUSTABLE PICTURE HANGER

(76) Inventor: Michael Zuller, 6 Governors Ct., Great Neck, NY (US) 11023

( * ) Notice: Subject to any disclaimer, the term of this patent is extended or adjusted under 35 U.S.C. 154(b) by 0 days.

(21) Appl. No.: 10/267,265

(22) Filed: Oct. 9, 2002

(65) Prior Publication Data

US 2003/0029986 A1 Feb. 13, 2003

Related U.S. Application Data

(63) Continuation-in-part of application No. 09/783,267, filed on Feb. 12, 2001, now abandoned.

(51) Int. Cl.[7] ..... A47G 1/16
(52) U.S. Cl. ..... 248/476; 248/495; 40/757
(58) Field of Search ..... 248/222.12, 292.12, 248/297.21, 297.31, 407, 408, 466, 475.1, 476, 477, 478, 495, 496; 40/757

(56) References Cited

U.S. PATENT DOCUMENTS 445,942 A * 2/1891 Siddall ..... 248/495
935,797 A * 10/1909 Leonard ..... 248/496
1,182,702 A * 5/1916 Niles ..... 248/297.21
1,242,309 A * 10/1917 Backerud ..... 248/496
1,432,206 A * 10/1922 Poole ..... 248/476
1,755,453 A * 4/1930 Mullen ..... 248/48.1
1,947,165 A * 2/1934 Nelke ..... 211/88.01
2,335,896 A * 12/1943 Anderson ..... 248/476
2,463,110 A * 3/1949 Johnson ..... 248/496
2,569,622 A * 10/1951 Trainor ..... 248/477
2,674,431 A * 4/1954 Attwood ..... 248/243
2,943,831 A * 7/1960 Goss ..... 248/495
2,975,994 A * 3/1961 Goss ..... 248/496
3,064,724 A * 11/1962 Nowell ..... 160/330
3,285,549 A * 11/1966 Cook ..... 248/495
3,583,734 A * 6/1971 Magi ..... 403/96
4,024,659 A * 5/1977 Ingerdahl ..... 40/741
4,228,982 A * 10/1980 Sellera ..... 248/467
4,343,450 A * 8/1982 Anderson ..... 248/454
4,892,284 A * 1/1990 Kelrick ..... 248/476
5,878,987 A * 3/1999 Hayde ..... 248/477
5,918,938 A * 7/1999 Miotto ..... 297/353
6,003,825 A * 12/1999 Abernathy, Jr. ..... 248/478
6,032,915 A * 3/2000 Brindisi ..... 248/466
6,095,479 A * 8/2000 Brindisi ..... 248/476

* cited by examiner

*Primary Examiner*—Ramon O. Ramirez
*Assistant Examiner*—Jon Szumny
(74) *Attorney, Agent, or Firm*—Muserlian, Lucas and Mercanti, LLP

(57) ABSTRACT

A picture hanger with a height adjustable hook allows the height of the picture to be adjusted from time to time. The hanger uses a back plate on which two opposed crenelated tracks are positioned. Two spring biased crenelated cars are housed in a frame and move on the tracks. The hook is attached to the frame. The frame is either a traveling plate which moves between the tracks and the back plate or a traveling block which is slidably mounted in a channel in the back plate and on a rod positioned in the channel of the back plate.

20 Claims, 7 Drawing Sheets

HEIGHT ADJUSTABLE PICTURE HANGER

CROSS-REFERENCE TO RELATED APPLICATIONS

This application is a continuation-in-part of prior filed U.S. patent application Ser. No. 09/783,267 filed Feb. 12, 2001, now abandoned and claims the benefit thereof under 35 USC 120.

BACKGROUND OF INVENTION

1. Technical Field

The present invention relates to wall mounted picture hangers and, more specifically, to wall a mounted picture hanger with a height adjustable hook.

2. Related Art

Wall mounted adjustable picture and mirror hangers are old. Generally, such hangers can be divided between those that have one unit fixed to the wall and a second unit fixed to the back of the picture and those that have a first unit fixed to the wall and a second adjustable unit movably mounted on the first unit. In the first type of hangers, the second unit travels on and is supported by the first unit, see for example, U.S. Pat. Nos. 1,432,206; 2,569,622; 2,943,831; 2,975,994; 3,285,549; 4,228,982; 5,878,987; 6,032,915; and 6,095,479. In the second type of picture hanger, the second unit has a hook from which the picture hangs by means of wire conventionally attached to the back of the picture. This second type of hanger is exemplified in U.S. Pat. Nos. 1,182,702; 4,892,284; and 6,003,825.

The second type of picture hanger is preferable over the first type because most pictures are mounted in frame and have wire attached to the back of the frame for hanging the picture from the wall. Thus, only one step is necessary to employ the hanger, i.e. attach the hanger to the wall.

There is a need for a simple height adjustable picture hanger which is easy to attach to the wall and has a hook which is adjustable in height and from which a picture can be conventionally hung by means of wire.

SUMMARY OF INVENTION

A height adjustable picture hanger has now been discovered that is easy to attach to the wall and has a vertically adjustable hook. The present invention is employed for both pictures and mirrors which have a wire, hole or hook on the back to which the hook of the present invention is attached.

It has been discovered that a simple height adjustable picture hanger can be made by employing two opposed vertical oriented crenelated tracks which are affixed to the wall in conjunction with two biased, crenelated cars which travel in the crenelated tracks. The cars are housed in a frame which keeps the cars horizontally aligned with each other and allows for horizontal movement of the cars. A hook is attached to the frame. The hook attaches to the wire, hole, or hook of the picture. The frame moves vertically with the cars while maintaining the horizontal alignment of the cars in the tracks. The frame also prevents the cars from falling forward out of the tracks.

By moving the cars in the tracks, the hook moves vertically, thereby providing height adjustment for the picture or mirror. The use of a crenelate track with crenelate cars housed in a frame provide stability to the picture hanger.

Broadly, the present invention is a height adjustable picture hanger comprising: two opposed, vertically oriented, crenelated tracks which are affixed to the wall; two opposed spring biased cars positioned between the tracks, each car has a crenelated surface that mates with one of the crenelated tracks, the cars being movable along the tracks; a frame positioned between said tracks, housing said cars and movable therewith; and a hook attached to said frame and movable therewith.

The term "crenelated" as used herein means a straight surface with evenly spaced and dimensioned teeth. The tracks have a plurality of such teeth while each car has at least one and preferably two, three or four teeth.

Preferably, stability is provided to the present invention by employing a back plate which is affixable to the wall and on which the tracks are mounted. The back plate provides stability to the tracks as well as the overall hanger.

The frame which houses the cars can take the form of a block or a plate hereinafter referred to as a traveling block or a traveling plate.

In one preferred embodiment of the present invention, the hanger employs a back plate which is attachable to a wall; a channel which is vertically oriented and centrally located in the back plate, both ends of the channel being closed; a rod which is centrally located in said channel and extended between both ends of the channel; and a traveling block which is positioned in the channel and having a hole therethrough in which the rod passes, the block is vertically movable on said rod. The block is the frame and is attached to the hook and houses the cars while the tracks are attached to the back plate and positioned on either side of the channel.

In another preferred embodiment of the present invention, the hanger employs a back plate which is attached to the wall and on which the tracks are mounted, the tracks are spaced away from the back plate thereby providing a space therebetween; and a traveling plate attached to the hook, houses the cars and extends into the space between the tracks and back plate.

The traveling block provides stability in combination with a vertically oriented rod. The rod is attached to the back plate and the traveling block is affixed to and movable along the rod through a hole within the traveling block. Thus, the cars cannot be removed from the picture hanger by the weight of a picture or mirror.

The traveling plate provides stability since it is positioned between the back plate and the crenelated tracks. When such an arrangement is utilized, the weight of a picture or mirror cannot disengage the cars from the picture hanger, since the cars are interconnected to the traveling plate, and the traveling plate always remains between the back plate and the crenelated tracks.

Preferably, the back plate of the picture hanger of the present invention has one or more holes through which a screw can pass so as to affix the hanger to the wall. If one single hole is used, it is suitably positioned half-way across the back plate in the upper half of the back plate so as to affix the picture hanger evenly (horizontally level) to the wall. Alternatively, when the back plate is not present, the crenelated tracks can be directly attached to the wall by screws passing through holes in the crenelated tracks.

Preferably, the picture hanger of the present invention has four holes positioned around the back plate through which a screw can pass so as to affix the hanger to the wall.

More preferably, the picture hanger of the present invention has a bubble gauge. The bubble gauge affixes to the back plate and allows the user to insure that the hanger is horizontally level.

In a preferred embodiment, the present invention is a wall mounted picture hanger having a height adjustable hook which comprises: a back plate attachable to a wall; a channel is vertically oriented and centrally located in the back plate, both ends of the channel are closed; a rod is centrally located in the channel and extends between both ends of the channel; two opposed, vertically oriented, crenelated tracks are mounted on the back plate on either side of the channel; a traveling block is positioned in the channel and has a hole therethrough in which said rod passes, said block is vertically movable on said rod; two spring biased cars are housed in the block and positioned between the crenelated tracks, each of the cars having a crenelated surface which mates with one of the crenelated tracks; and a hook is affixed to the block for hanging a picture therefrom.

In another preferred embodiment, the wall mounted picture hanger of the present invention comprises: a back plate attachable to a wall; two opposed, vertically oriented, crenelated tracks mounted on said back plate and spaced away from said back plate so as to create a space between said back plate and said tracks; a traveling plate positioned between said crenelated tracks and extending into the space between said back plate and said tracks and vertically movable therein; two, spring biased cars housed in said traveling plate and positioned between said crenelated tracks, each of said cars having a crenelated surface which mates with one of said crenelated tracks; and a hook affixed to said traveling plate for hanging a picture therefrom.

These and other aspects of the present invention may be more fully understood by reference to the following drawings and the detailed description of the invention.

DETAILED DESCRIPTION OF INVENTION

Figure 1:
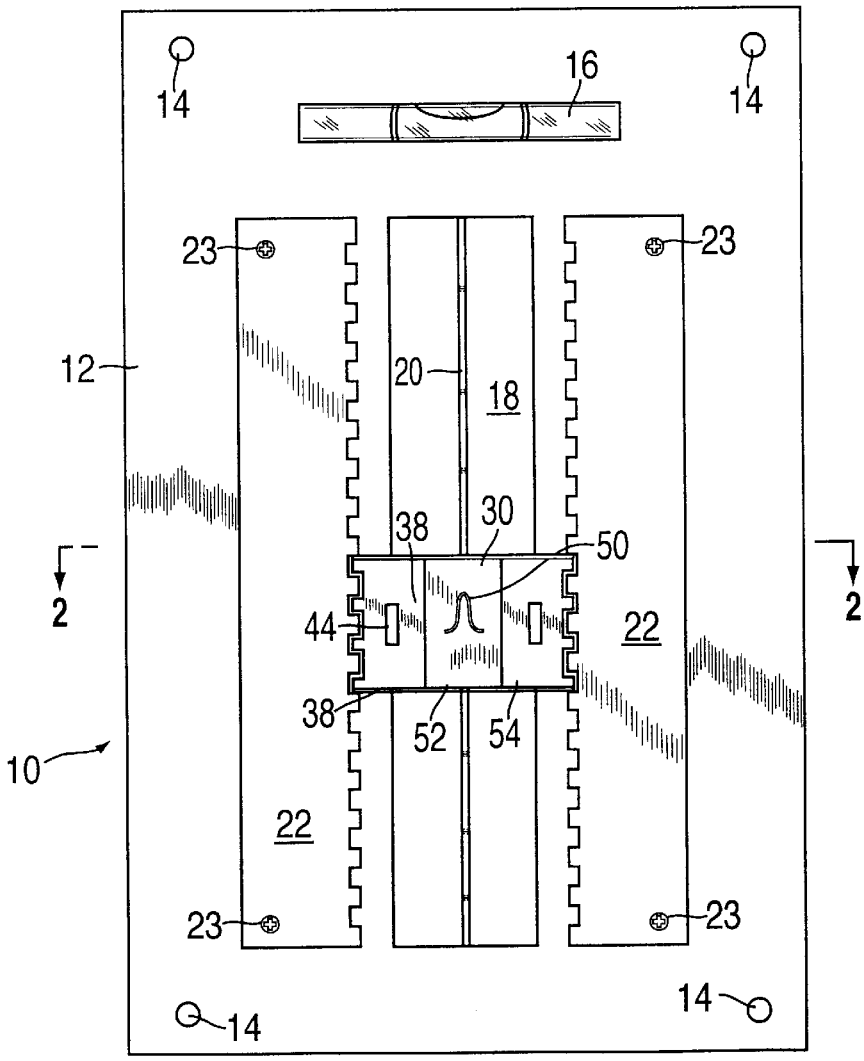
FIG. 1 illustrates a front view of one embodiment of the picture hanger of the present invention.

In FIG. 1, picture hanger 10 has a back plate 12 which has four holes 14 in the frame for attachment of plate 12 to the wall. Plate 12 has bubble gauge 16 for horizontally orienting picture hanger 10. In the center of plate 12 is located channel 18 in which rod 20 resides. Bordered on either side of channel 18 are crenelated or toothed tracks 22 which are mounted on back plate 12 by screws 23. Residing in and movable in channel 18 is traveling block 30. Screws, not shown, can be used in holes 14 to affix hanger 10 to a wall.

Figure 2:
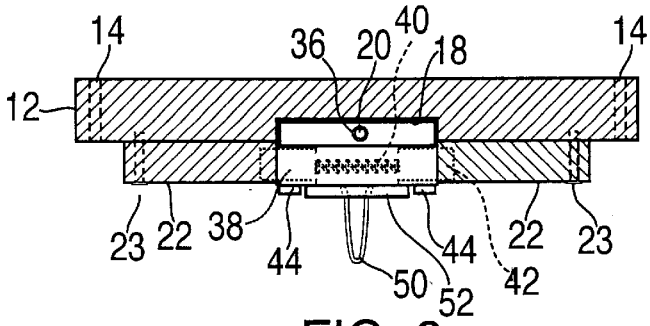
FIG. 2 illustrates a top view of the hanger taken along line 2—2 of FIG. 1.

FIG. 2 is a top view taken along lines 2—2 of FIG. 1. As shown in FIG. 2, block 30 extends into channel 18. Rod 20 passes through hole 36 of traveling block 30.

Figure 3:
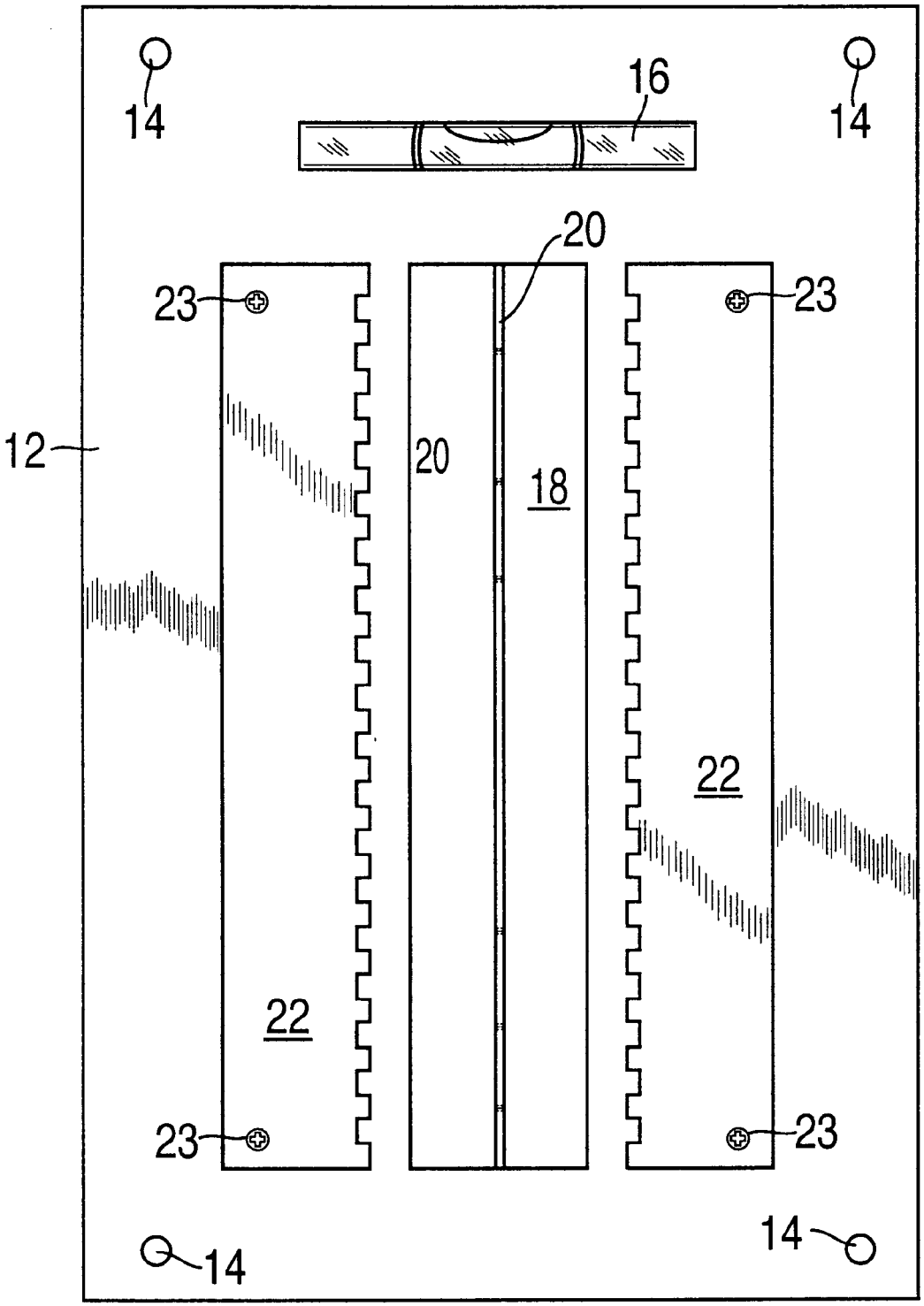
FIG. 3 illustrates a front view of the back plate with the channel, the rod, the gauge and the two crenelated tracks.

FIG. 3 illustrates a front view of the back plate 12 without traveling block 30 therein.

Figure 4:
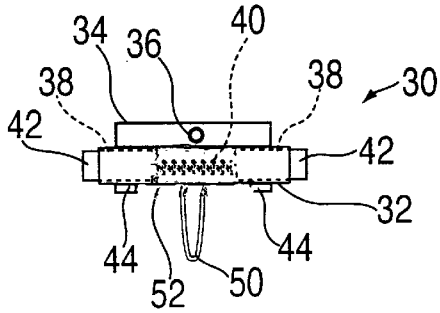
FIG. 4 illustrates a top view of the hook, traveling block, and two crenelated cars.
Figure 5:
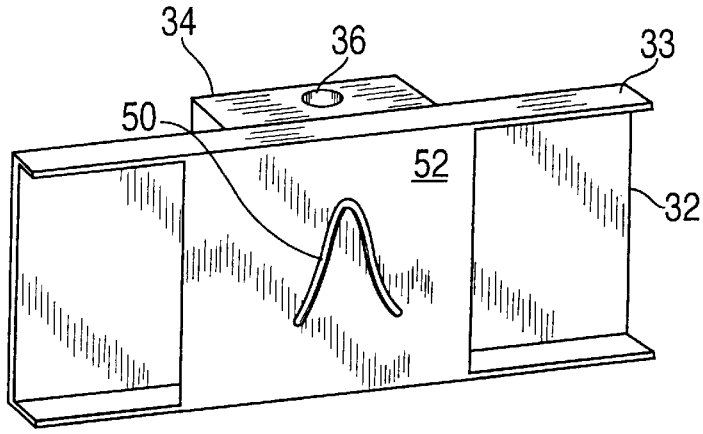
FIG. 5 illustrates the traveling block.
Figure 6:
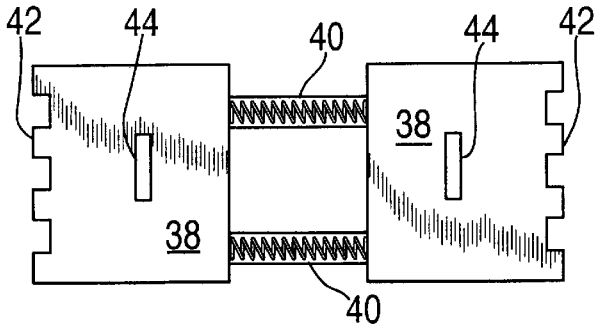
FIG. 6 illustrates the two crenelated cars with coil springs therebetween.
Figure 7:
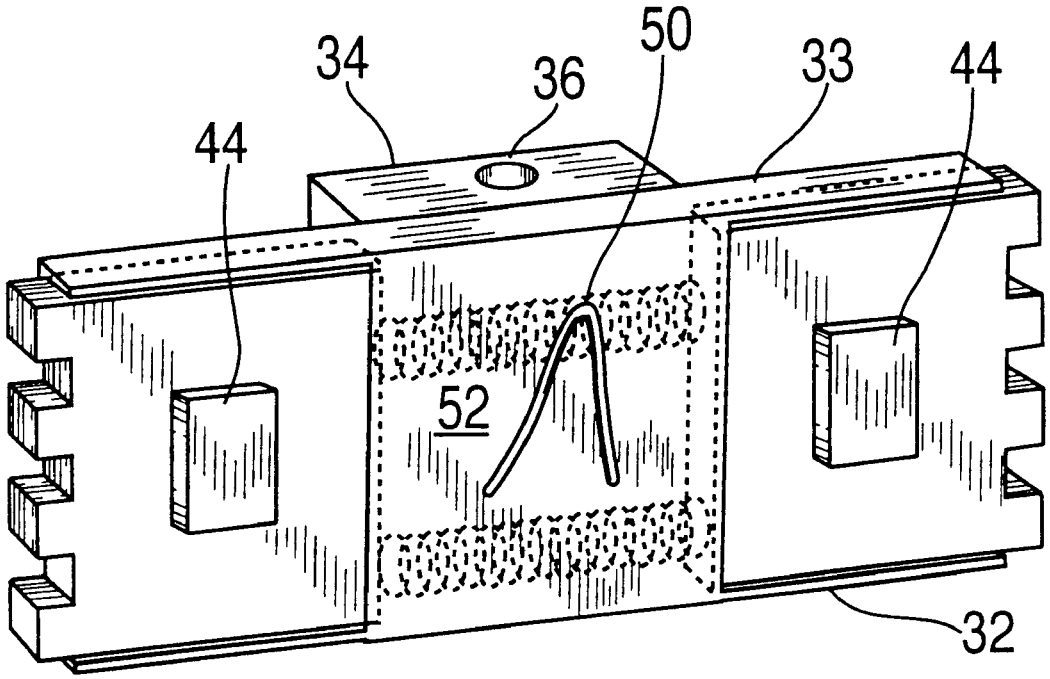
FIG. 7 illustrates the traveling block with cars.

FIGS. 4 through 7 illustrate the various elements associated with traveling block 30. FIG. 4 is a top view of traveling block 30 while FIGS. 5 through 7 illustrate the different parts associated with traveling block 30.

Traveling block 30 comprises frame section 32 with back block 34 that extends into and travels in channel 18. Back block 34 has hole 36 for accommodating rod 20. Inside of frame section 32 resides two spring biased crenelated cars 38 which are forced outward by coil springs 40. Each one of cars 38 has teeth 42 which match the teeth in tracks 22. Cars 38 have finger grips 44 which allow the user to compress springs 40 and disengage teeth 42 from the teeth of tracks 22, thereby allowing the vertical movement of traveling block 30, cars 38 and hook 50. Positioned on the outside of block 30 is hook 50. Hook 50 is attached to front plate 52 of frame section 32 while back block 34 is attached to the back of frame section 32.

Front plate 52 extends over one side of each of cars 38 as shown in FIG. 4 so as to maintain cars 38 in traveling block 30. The horizontal ledges 33 of frame section 32 maintain the horizontal orientation of cars 38 while allowing cars 38 to move horizontally when the user compresses springs 40 using grips 44.

Figure 8:
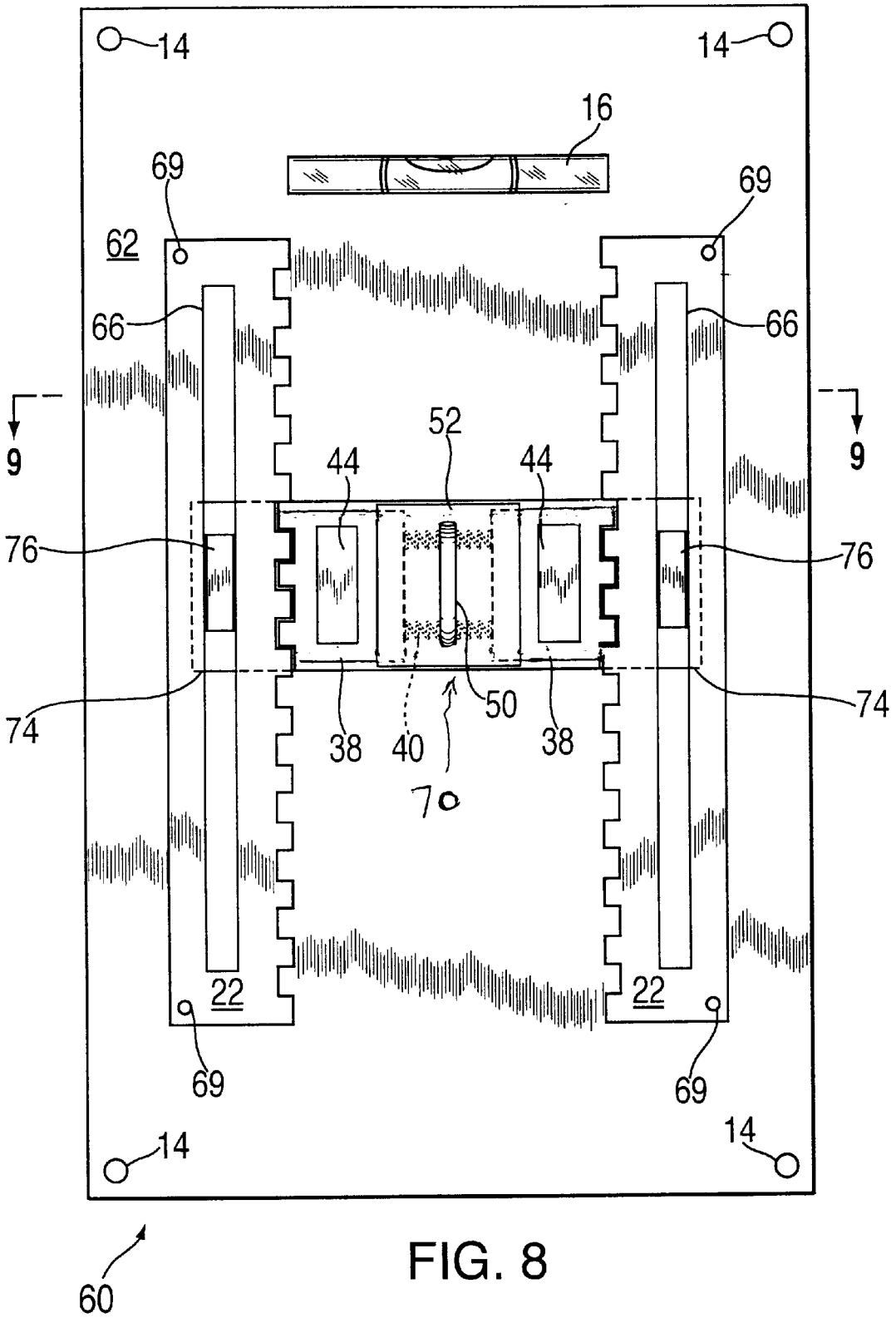
FIG. 8 illustrates a front view of another embodiment of the picture hanger of the present invention.
Figure 9:
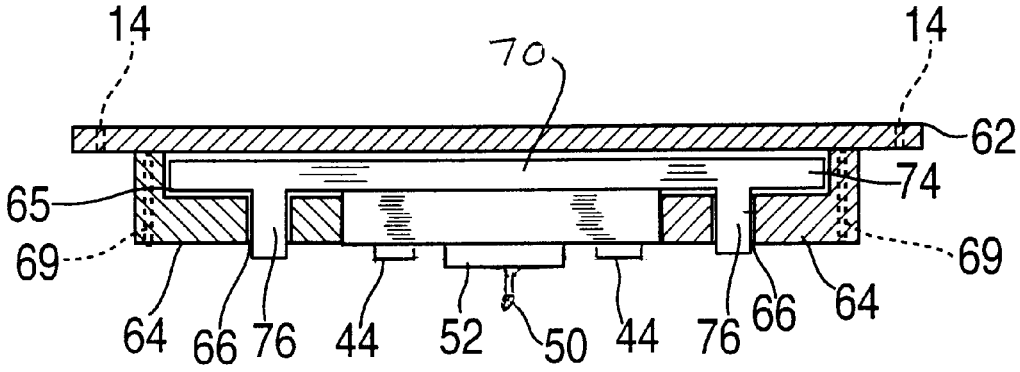
FIG. 9 illustrates a top view of the hanger taken along lines 9—9 of FIG. 8.
Figure 10:
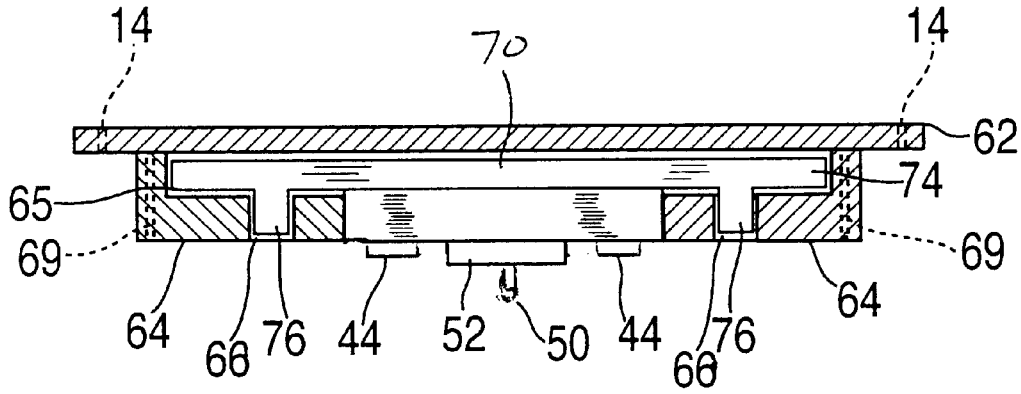
FIG. 10 illustrates a top view of another embodiment of the hanger of FIG. 8.

FIGS. 8 and 9 illustrate picture hanger 60 with back plate 62 and tracks 64 positioned away from the face of plate 62 to create space 65. Traveling plate 70 with extensions 74 move in space 65 therebetween. Each track 64 has longitudinal holes 66 in which tabs 76 travel. Tabs 76 are affixed to extensions 74. Tabs 76 and holes 66 help maintain alignment between plate 70 and tracks 64. Longitudinal guide holes 66 extend through tracks 64, however, they need not extend completely through tracks 64 but can be channels 68 as shown in FIG. 10. Alternatively, no longitudinal holes 66 and no tabs 76 are employed as shown in FIGS. 11 and 12.

Tracks 64 are attached at either end to back plate 62 by screws 69 or other conventional means.

Figure 11:
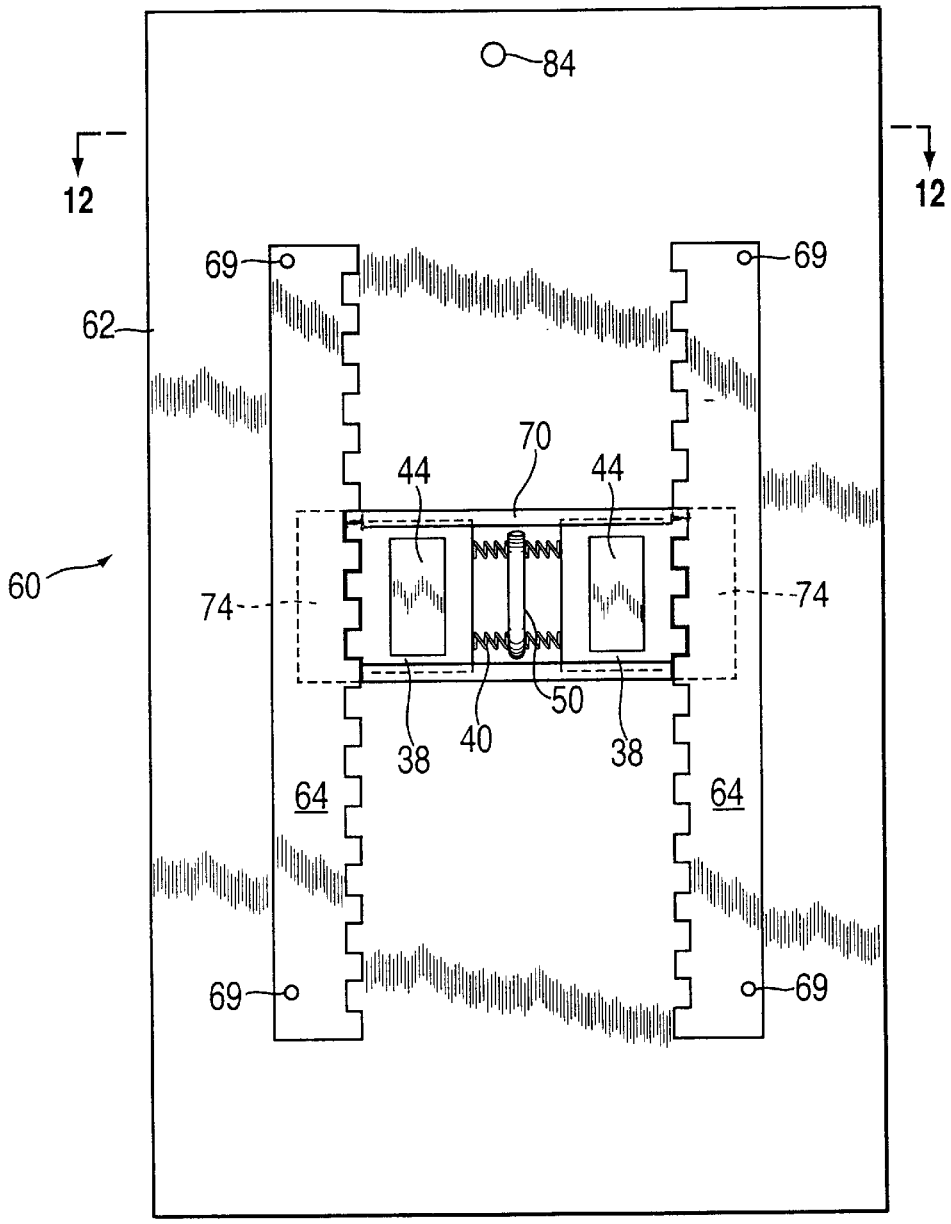
FIG. 11 illustrates a front view of the hanger of FIG. 8 without the longitudinal holes and without the tabs.
Figure 12:
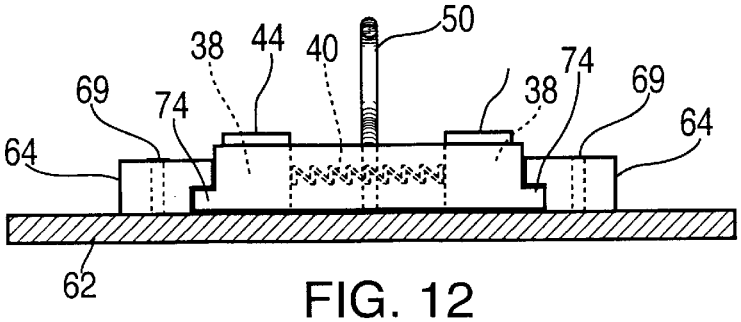
FIG. 12 illustrates a top view of the hanger of FIG. 11 taken along lines 12—12.

As illustrated in FIGS. 11 and 12, tracks 64 have no longitudinal hole and traveling plate 62 has no tabs.

In FIG. 11, picture hanger 60 has a back plate 62 which has one single hole 84 positioned half-way across back plate 62 in order to properly align picture hanger 60.

Crenelated tracks 64 as shown in FIGS. 8 and 11 can be alternatively mounted directly to the wall using screws 69 without the need for back plate 62. With such an arrangement, the wall performs a similar function to back plate 62, i.e., crenelated tracks 62 are screwed into the wall, and traveling plate 70 moves between crenelated tracks 64 and the wall.

FIGS. 8–12 illustrate tracks 64 which have an L-shaped cross-section and screws 69 are moved horizontally outward not in line with space 65.

Figure 13:
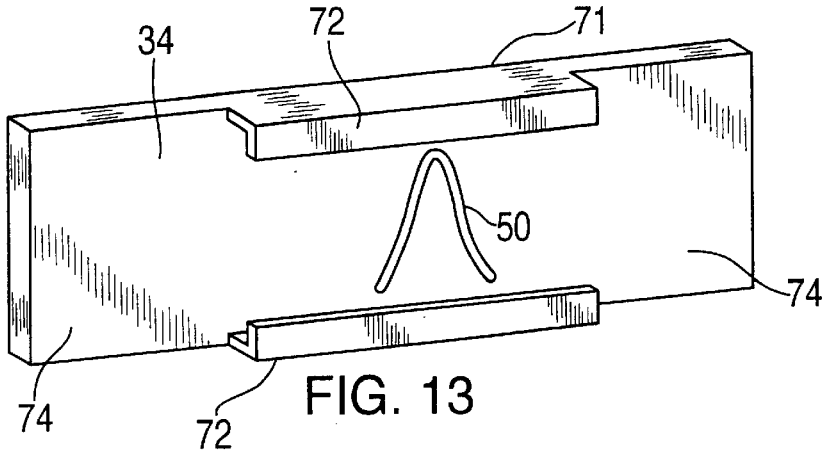
FIG. 13 illustrates a front view of a traveling plate.

As shown in FIG. 13, traveling plate 70 has frame section 71 which is C-shaped in cross-section. Each end of frame section 71 is U-shaped 72 to provide an upper and lower channel in which cars 38 ride horizontally. Hook 50 is mounted on frame section 71.

As can be seen in FIGS. 8 and 11, hook 50 extends outward from frame section 71 between springs 40.

As shown in FIG. 12, the top and bottom of space 65 is open to allow extensions 74 to enter and exit. Tabs 76 can be removable, allowing traveling plate 70 with cars 38 to be moved onto and removed from tracks 64.

Finger grips 44 can be small finger grips 44 as shown in FIGS. 8–10 or can be the majority of car 38 as shown in FIGS. 11–12.

As will be appreciated, traveling block 30 or plate 70 can be formed as one piece.

Suitably, the hanger of the present invention is small enough to fit behind and be hidden by the picture. Suitably, the back plate and, thus, the overall dimensions of the unit, are about four (4) inches in height, about three (3) inches in width, and no more than one (1) inch thick. Since both the size and weight of pictures and mirrors can vary, the dimensions of the hanger of the present invention can vary.

The hanger of the present invention can be made from any conventional material such as plastic or metal, however, metal is preferred for strength.

It will be understood that the claims are intended to cover all changes and modifications of the preferred embodiments of the invention herein chosen for the purpose of illustration which do not constitute a departure from the spirit and scope of the invention.

What is claimed is:

1. A wall mounted picture hanger having a height adjustable hook comprising:

two opposed vertically oriented crenelated tracks affixable to a wall;

two opposed spring biased cars positioned between said tracks, each car having a crenelated surface that mates with one of said crenelated tracks, said cars movable in said tracks;

a frame positioned between said tracks and housing said two cars and allowing horizontal movement of said two cars in said frame, said frame movable with said cars and preventing said two cars from falling out of said tracks; and a hook affixed to said frame for movement therewith.

2. The picture hanger of claim 1 further comprising:

a back plate attachable to said wall;

a channel vertically oriented and centrally located in said back plate, both ends of said channel being closed;

a rod centrally located in said channel and extended between both ends of said channel;

said tracks mounted on said back plate and positioned on either side of said channel; and said frame is a traveling block positioned in said channel and having a hole therethrough in which said rod passes, said block vertically movable on said rod.

3. The picture hanger of claim 2 wherein said back plate has four holes positioned around said plate through which screw can pass so as to affix said hanger to said wall.

4. The picture hanger of claim 2 further comprising a bubble gauge, said bubble gauge affixed to said back plate.

5. The picture hanger of claim 2 wherein said traveling block comprises a frame section positioned between said tracks, said two cars movably housed in said frame section, said hook attached to the front of said frame section and back block attached to the back of said frame section, said back block having said hole through which said rod passes.

6. The picture hanger of claim 1 wherein said frame is a traveling plate affixed to said hook and housing said cars, said two tracks are positioned away from said wall so as to provide a space between said wall and said tracks, said traveling plate extending into said space between said tracks and said wall.

7. The picture hanger of claim 1 further comprising:

a back plate affixable to said wall, said tracks affixed to said back plate and spaced away from said back plate so as to provide a space between said tracks and said back plate; and said frame is a traveling plate affixed to said hook and to said cars, said traveling plate extending into said space between said back plate and said tracks.

8. The picture hanger of claim 7 wherein said back plate has four holes positioned around said back plate through which screw can pass so as to affix said hanger to said wall.

9. The picture hanger of claim 7 further comprising a bubble gauge, said bubble gauge affixed to said back plate.

10. The picture hanger of claim 7 wherein said traveling plate comprises a frame section positioned between said tracks, said two cars movably housed in said frame section and said hook attached to said frame section and extensions extending from said frame section and into said space.

11. A wall mounted picture hanger having a height adjustable hook comprising:

a back plate attachable to a wall;

a channel vertically oriented and centrally located in said back plate, both ends of said channel are closed;

a rod centrally located in said channel and extend between both ends of said channel;

two opposed, vertically oriented, crenelated tracks mounted on said back plate on either side of said channel;

a traveling block positioned in said channel and having a hole therethrough in which said rod passes, said block vertically movable on said rod;

two spring biased cars housed in said block, and positioned between said crenelated tracks, each of said cars having a crenelated surface which mates with one of said crenelated tracks; and a hook affixed to said block for hanging a picture therefrom.

12. The picture hanger of claim 11 wherein said back plate has four holes positioned around said plate through which screw can pass so as to affix said hanger to said wall.

13. The picture hanger of claim 11 further comprising a bubble gauge, said bubble gauge affixed to said back plate.

14. The picture hanger of claim 11 wherein said traveling block has a frame section positioned between said tracks, said two cars movably housed in said frame section and said hook attached to said frame section and a back block having said hole through which said rod passes.

15. The picture hanger of claim 11 wherein each track has a longitudinal hole therein and each side of said plate has a tab which extends into said longitudinal hole.

16. The picture hanger of claim 11 wherein each track has a channel and each side of said plate has a tab which extends into said channel.

17. A wall mounted picture hanger having a height adjustable hook comprising:

a back plate attachable to a wall;

two opposed, vertically oriented, crenelated tracks mounted on said back plate and spaced away from said back plate so as to provide a space between said back plate and said tracks;

a traveling plate positioned between said tracks and extending into said space;

two spring biased cars housed in said traveling plate horizontally movable in said traveling plate and positioned between said crenelated tracks, each of said cars having a crenelated surface which mates with one of said crenelated tracks said cars being prevented from falling forward out of said tracks by said plate; and a hook affixed to said plate for hanging a picture therefrom.

18. The picture hanger of claim 17 wherein said back plate has four holes positioned around said plate through which screws can pass so as to affix said hanger to said wall.

19. The picture hanger of claim 17 further comprising a bubble gauge, said bubble gauge affixed to said back plate.

20. The picture hanger of claim 17 wherein said traveling plate comprises a frame section positioned between said tracks, said two cars movably housed in said frame section and said hook attached to said frame section and extensions extending from said frame section and into said space.

* * * * *